US005165190A

United States Patent [19]

Smyth

[11] Patent Number: 5,165,190

[45] Date of Patent: Nov. 24, 1992

[54] LACELESS SHOE FASTENER

[76] Inventor: Donna Smyth, 2320 37th St., Des Moines, Iowa 50310

[21] Appl. No.: 553,242

[22] Filed: Jul. 16, 1990

[51] Int. Cl.[5] ..... A43B 11/00; A44B 9/00

[52] U.S. Cl. ..... 36/50; 2/DIG. 6; 24/712.3; 36/136

[58] Field of Search ..... 36/50, 136; 2/DIG. 6; 24/712.3, 712.2, 712.1

[56] References Cited

U.S. PATENT DOCUMENTS

| | | | |
|---|---|---|---|
| 4,414,761 | 11/1983 | Mahood | 36/50 |
| 4,592,154 | 6/1986 | Oatman | 36/50 X |
| 4,630,383 | 12/1986 | Gamm | 36/136 |
| 4,642,914 | 2/1987 | Caldeira | 36/50 |
| 4,733,439 | 3/1988 | Gentry | 36/50 X |
| 4,771,556 | 9/1988 | Kim | 36/50 X |
| 4,879,787 | 11/1989 | Walls | 24/712.2 |
| 4,901,452 | 2/1990 | Wang | 36/50 |
| 4,907,352 | 3/1990 | Ginsberg | 36/50 |
| 5,042,119 | 8/1991 | Williams | 24/712.3 |

FOREIGN PATENT DOCUMENTS

| | | | |
|---|---|---|---|
| 648959 | 8/1937 | Fed. Rep. of Germany | 24/712.3 |

*Primary Examiner*—Paul T. Sewell
*Assistant Examiner*—Beth Anne Cicconi
*Attorney, Agent, or Firm*—James D. Birkenholz

[57] ABSTRACT

A laceless shoe fastener adapted for usage with a conventional shoe having eyelets utilizing the first and second closure flaps. Securing straps extend from each of the closure flaps and pass through eyelets. The fastener fabric of the hook and pile type cover the bottom of the first flap and top of the second flap and the securing straps to securely hold the first and second closure flaps and securing straps together when engaging together.

3 Claims, 1 Drawing Sheet

LACELESS SHOE FASTENER

BACKGROUND OF THE INVENTION

1. Field of The Invention

The present invention relates generally to footware and particularly the provision of a shoe closure adapted for usage with a shoe having conventional eyelets.

2. Discussion Of Prior Art

In the footware art, there are various devices and modes available for the securing of the shoe on the person's foot. The conventional shoe teaches the use of laces passing through eyelets within the upper assembly of the shoe overlying the tongue of the shoe which are drawn tight to secure the shoe about the foot. The art also teaches the use of straps secured to one side of the shoe near the tongue region and passing over the tongue to the other side of the shoe. Attached to the strap is a velcro-type fabric fastener with a complimentary velcro fastener also being fastened to the side of the shoe where the strap is pulled. Upon the strap being extended over the top of the shoe to contact the complimentary velcro fabric fastener, the shoe is held in place. Other art in this area includes Caldeira U.S. Pat. No. 4,642,914 which teaches the use of velcro straps passing through a loop assembly with the strap being folded over upon itself to secure the closure of the shoe assembly. Further, Stone U.S. Pat. No. 4,377,913 teaches the use of velcro on the tongue and throat edges of the shoe which engage each other. The art does not address the problem of utilization of the velcro type of fastening fabric with conventional shoes or footware which already have spaced eyelets disposed within the tongue assembly of the shoe and which is adopted heretofore for usage with laces. Further, the art does not address the problem associated with different or multiple spacing of the eyelets and does not provide a velcro shoe fastener which is readily adaptable and movable from one to another utilizing different spacing of eyelets and sizes.

SUMMARY OF THE INVENTION

The first and second closure flaps are provided generally rectangular in configuration corresponding to the instep region of the shoe which includes a tongue portion of the shoe having eyelets. Attached to the bottom of the first flap and the top of the second flap is fastener fabric of the hook and pile type. Securing straps extend from the first and second closure flaps and extend through the shoe eyelets. The securing straps are formed from extension of the fastener fabric attached to the first and second closure flaps and the opposing fastener fabric which forms securing straps to engage the securing straps formed from the fastener fabric of the first and second closure. The securing straps are held in place through the action of the fastener fabric and upon crossing over of the first and second closure flaps and pressing of the flaps together, the shoe is tighten about the foot and held in place.

DESCRIPTION OF THE PREFERRED EMBODIMENT

Figure 1:
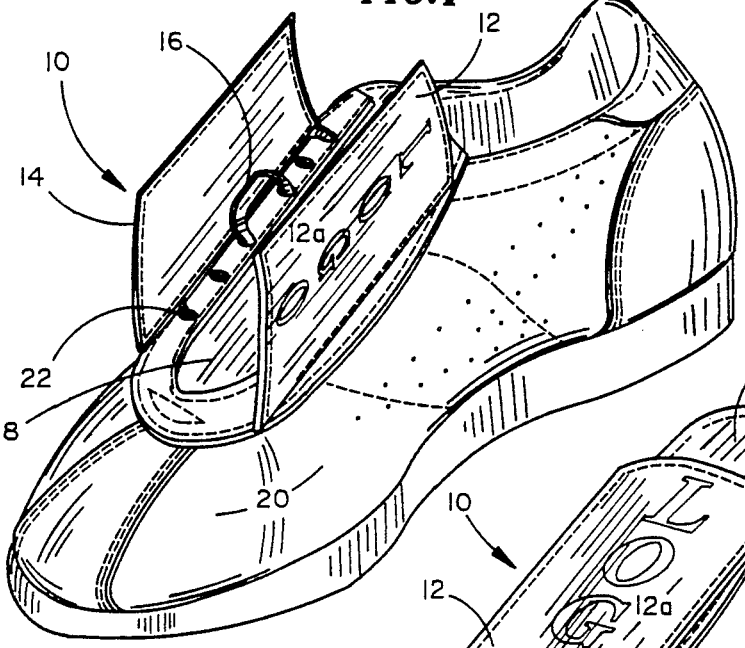
FIG. 1 is a perspective view of a conventional shoe illustrating the laceless shoe fastener of the present invention with the first and second closure flaps spaced apart from each other.
Figure 2:
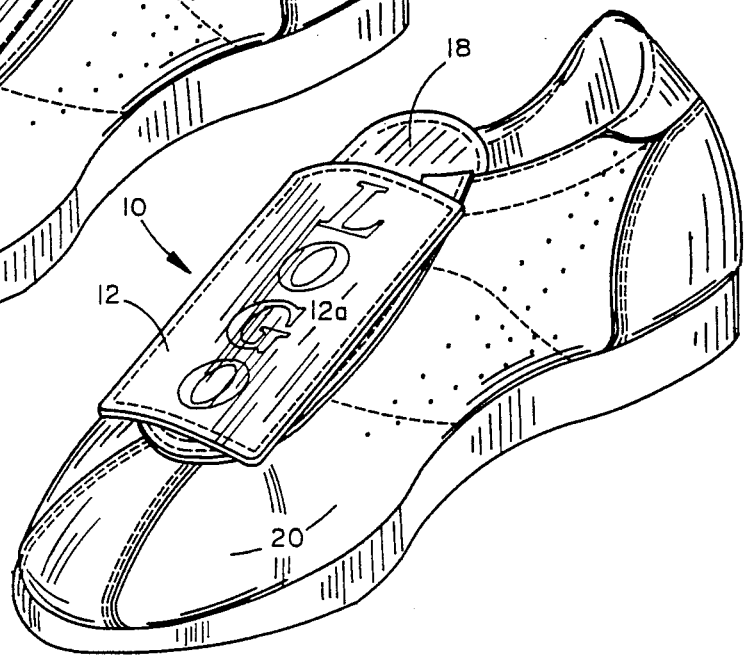
FIG. 2 illustrates the laceless shoe fastener with the first and second closure flaps engaging each other.
Figure 3:
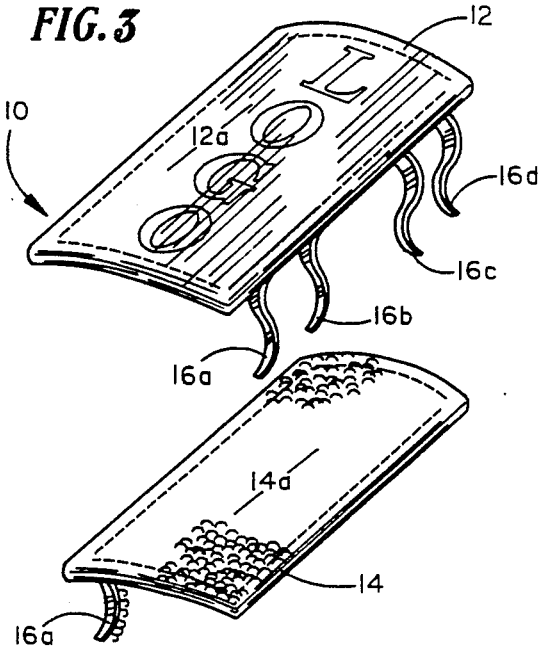
FIG. 3 is an elevated perspective view of the top of the first and second closure flaps and securing straps.
Figure 4:
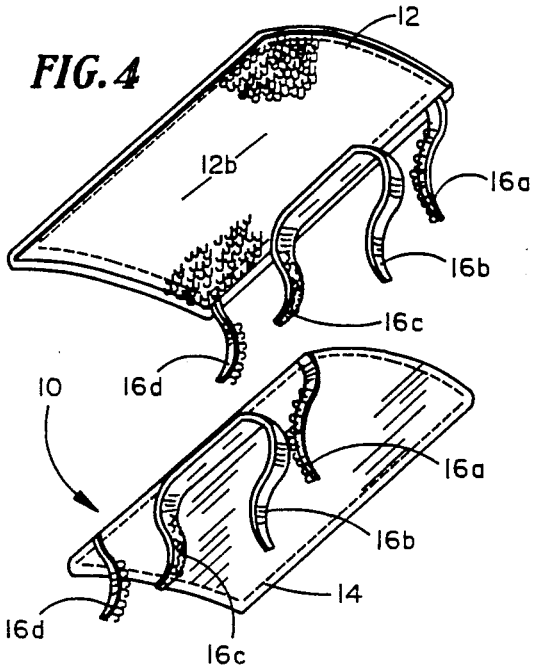
FIG. 4 is a perspective view of the bottom of the first and second closure flaps and securing straps.

Referring now to the drawings wherein like referenced numerals designate identical or corresponding parts throughout the several views, the laceless shoe fastener of the present invention is illustrated generally at 10 in FIG. 1.

Generally, the laceless shoe fastener 10 (FIGS. 1–4) includes a first and second closure flap 12 and 14, respectively, and securing straps 16. The laceless shoe fastener 10 further utilizes material known generally as fastener fabric and commonly referred to as "velcro". Velcro utilizes two surfaces which engage each other through a series of hook-like projectiles on one surface which engage loops on the other surface. The first and second closure flaps 12 and 14 are generally rectangular in shape to overlay the tongue region 18 of a shoe 20. Shoe 20 may be of a conventional design heretofore adapted to use lace through eyelets 22 to tighten the shoe 20 about the foot. The eyelets 22 typically are disposed about the instep region which includes the tongue region 18 of the shoe 20.

The underside surface **12*b* (FIG. 1–4) of the first closure flap 12 and the top surface 14*a* of the second closure flap are covered with the fastener fabric-velcro with one surface having the hook-like projectiles and the other surface having the loop material. When the two surfaces 12*b* and 14*a* are pressed together they lock each other through the action of the velcro fabric. The securing straps 16 are located on the underside of the closure flap 12 and 14. The securing straps 16*a* and 16*d* are generally elongated continuation sections of the respective velcro fabric attached to the underside surface 12*b* of the first closure flap 12, and respectively the top surface 14*a* of the second closure flap 14. The inner securing straps 16*b* and 16*c* are formed from the velcro fabric opposite that of the fabric which is attached to the respective closure flaps 12 and 14. The securing straps 16*b* and 16*c* are normally formed from one section of the velcro fabric and attach to the underside of the closure flaps 12 and 14 by stitching or an appropriate adhesive. The securing straps 16*a*, 16*b*, 16*c*, and 16*d* each pass through an eyelet on the shoe and the straps 16*a* and 16*b* and straps 16*c* and 16*d* are pressed together so that the velcro fabric engages which secures the first and second closure flaps 12 and 14 on to the shoe. The second closure flap 14 is held across the shoe and the first closure flap 12 is likewise pulled across the shoe in a tight fashion and pressed against the second first closure flap 14** to be locked into place.

The laceless shoe fastener 10 is adaptable for shoes where the physical dimensions between the eyelets 22 vary on the shoe itself as well as different shoes, i.e., children to adult. The securing straps 16 need only to extend to the eyelets 22 and engage a short length of each other in order to be held in place. Further, in situations where the eyelets 22 are close together in the case of small sized shoes or a particular design, the securing straps may be doubled up underneath the eyelets 22 or in some particular embodiments, one or more eyelets may be bypassed with the securing strap.

The top surface 12 of the first closure flap is adapted to require an ornamental design or logo which through the use of velcro fabric will secure the design.

Obviously, many modifications and changes to the preferred embodiment as set forth above would be possible to those skilled in the art. Such modifications if within the scope of the invention, are intended to be compassed within the claims to patent protection issuing hereon and the description of the preferred embodiment is set forth for illustrating purposes only.

I claim:

1. A laceless shoe fastener for conventional shoe footwear, the footwear having an instep region including a tongue and eyelets disposed along the perimeter of the instep region bordering the tongue, the fastener, comprising:

first and second closure flaps for overlying the tongue region of the shoe, the first and second closure flaps each having a top and bottom surface and each of the flaps including fastener fabric having complementary surfaces of hook and pile fastening material covering the bottom surface of the first closure flap and the top surface of the second closure flap to hold the first and second flaps together when the first and second closure flaps are in contact, and securing straps, each including at least two elongated sections extending from one of the first and second closure flaps for passing through at least one eyelet and which include fastener fabric on the end thereof to fixedly hold the elongated sections in contact with each other.

2. A laceless shoe fastener as claimed in claim 1 wherein the elongated sections of the securing straps are extensions of the fastener fabric.

3. A laceless shoe fastener as claimed in claim 2 wherein the top surface of the first flap includes an ornamental design.

* * * * *